US008312746B2

(12) United States Patent
Perez-Toril Galan

(10) Patent No.: US 8,312,746 B2
(45) Date of Patent: Nov. 20, 2012

(54) STAIN-REMOVING MACHINE

(76) Inventor: Francisco Javier Perez-Toril Galan, Cáceres (ES)

( * ) Notice: Subject to any disclaimer, the term of this patent is extended or adjusted under 35 U.S.C. 154(b) by 374 days.

(21) Appl. No.: 12/664,640

(22) PCT Filed: Jun. 6, 2008

(86) PCT No.: PCT/ES2008/000414

§ 371 (c)(1),
(2), (4) Date: Jan. 7, 2010

(87) PCT Pub. No.: WO2008/152168

PCT Pub. Date: Dec. 18, 2008

(65) Prior Publication Data

US 2010/0139332 A1 Jun. 10, 2010

(30) Foreign Application Priority Data

Jun. 14, 2007 (ES) ..... 200701282 U

(51) Int. Cl.
*D06B 5/12* (2006.01)

(52) U.S. Cl. ..... 68/200; 68/213

(58) Field of Classification Search ..... 68/213, 68/200

See application file for complete search history.

(56) References Cited

U.S. PATENT DOCUMENTS

| | | | | |
|---|---|---|---|---|
| 656,802 | A | 8/1900 | Batz | |
| 1,993,201 | A * | 3/1935 | Yandell | 68/242 |
| 2,225,089 | A * | 12/1940 | Vadnais | 383/43 |
| 2,254,691 | A * | 9/1941 | Maclelland, Jr. | 68/5 A |
| 2,301,227 | A * | 11/1942 | Pickett, Jr. et al. | 68/20 |
| 2,552,853 | A * | 5/1951 | Isserstedt | 68/213 |
| 4,120,180 | A * | 10/1978 | Jedora | 68/20 |
| 5,074,132 | A * | 12/1991 | Koller | 68/205 R |
| 5,206,970 | A * | 5/1993 | Johnson | 15/321 |
| 5,253,378 | A * | 10/1993 | Jung, Jr. | 8/149.1 |
| 5,402,657 | A * | 4/1995 | Henry, Jr. | 68/5 A |
| 5,493,744 | A | 2/1996 | Beckstein et al. | |
| 5,707,163 | A | 1/1998 | Gregory | |
| 7,814,768 | B2 * | 10/2010 | Vecchi et al. | 68/3 R |

(Continued)

FOREIGN PATENT DOCUMENTS

DE 296 12 960 * 11/1996

(Continued)

OTHER PUBLICATIONS

WIPO WO 98/04771 Feb. 1998.*

*Primary Examiner* — Frankie L Stinson

(74) *Attorney, Agent, or Firm* — Hultquist, PLLC; Steven J. Hultquist

(57) ABSTRACT

The invention relates to a stain-removing machine consisting of two tubes (2 and 3) which are joined to one another by a conventional closure and adjustment mechanism (6) including at least one rubber sealing section (7), the fabric (4) to be cleaned being clamped taut between said tubes with a fluid (5) flowing therebetween. The invention can also include a fill/discharge valve (8) for supplying/releasing the fluid (5) and said valve is moved by propulsion mechanisms or systems, such as mechanically or manually operated pistons (9, 9'). When the machine includes only one piston (9) the other tube (3) is provided with an elastic membrane (10) or a moving part. Optionally, the ends at which the tubes (2, 3) are joined are provided with securing and friction membranes or screens (13) or moving plates. The machine can be coupled to a professional stain-removing table (14) or to a domestic propulsion and suction source.

17 Claims, 4 Drawing Sheets

U.S. PATENT DOCUMENTS

2005/0284190 A1 12/2005 Fan et al.

FOREIGN PATENT DOCUMENTS

DE 10 2004 026 861 * 10/2005
JP 59-228064 * 12/1984
JP 7100288 A 4/1995
WO 9305225 A1 3/1993
WO 03074775 A2 9/2003

* cited by examiner

STAIN-REMOVING MACHINE

CROSS-REFERENCE TO RELATED APPLICATIONS

This application is a U.S. national phase under the provisions of 35 U.S.C. §371 of International Application No. PCT/ES08/00414 filed Jun. 6, 2008, which in turn claims priority of Spanish Patent Application No. U200701282 filed Jun. 14, 2007. The disclosures of such international application and Spanish priority application are hereby incorporated herein by reference in their respective entireties, for all purposes.

OBJECT OF THE INVENTION

As expressed by the title of the present specification, the invention relates to a stain-removing machine.

Specifically, the object of the invention consists of a machine, formed essentially by two tubes or containers, a fluid flowing therebetween, taking advantage of the stream established to perform the cleaning of fabrics inserted between said tubes, having the advantageous particularity of allowing the cleaning of only a certain part of said fabric in which the stain is located without needing to wet it and clean it entirely.

The proposed machine furthermore has means for holding up or securing the fabric which can likewise serve to cause a massage rubbing the stains, furthermore being able to incorporate additional means for the rubbing thereof.

In addition, by means of the appropriate modifications, the machine is suitable for being coupled both to a professional stain-removing table, of the type used in dry cleaners and establishments or specialized industries, and to a domestic fluid suction and propulsion source, such as a steam cleaning machine and a vacuum cleaner, with which the direction of the fluid or fluids can be varied, as desired, being a portable and low-cost stain-removing machine for domestic use.

FIELD OF THE INVENTION

The field of application of the present invention is within the industry dedicated to the manufacture of household appliances.

BACKGROUND OF THE INVENTION

Automatic or semiautomatic washing machines, generally with a capacity for several kilos of clothes, in which the clothing is introduced and a complete cleaning thereof is performed, are currently and as a reference to the state of the art widely known.

However, when simply a certain stain in a garment is to be cleaned and it is not desirable to wet and wash the entire garment, it is necessary to resort to chemical stain-removing products which remove it in dry conditions, which products are frequently not altogether efficient and, due to the composition thereof, represent an element that is potentially hazardous for the environment.

In addition, the alternative to chemical stain-removers is cleaning by hand, rubbing the part of the garment in which the stain is located, trying not to get the rest of the garment wet which, in addition to being complicated, does not commonly give satisfactory results, causing spots and creases which many times make one decide to wash the garment completely or, which is even worse, causing marks and deterioration in the fibers due to rubbing and brushing too hard.

In addition, stain-removing tables are known in dry cleaners and establishments or industries of the sector, which tables consist of a base or board, such as ironing boards, having a screen in which the area of the fabric to be cleaned is placed, applying, through the upper part thereof, different cleaning products or stain-removers with different types of guns, as the case may be:

water gun, with which water or only air can be applied, solvent gun, with which a solvent or only air can be applied, air gun, with a flat nozzle for drying, or steam gun.

A waste suction device is placed at the bottom part of the described mesh.

The drawback of this type of table is that they do not allow the use of certain products, such as chlorinated products, due to their toxicity, since it is an open cleaning system, in contrast to closed cleaning systems in which such products can be used.

It is therefore necessary to create a system allowing the partial washing of a garment or fabric, with the efficacy of a washing machine and without the drawbacks of the partial washing by hand or in dry conditions with chemical products, this being the main objective of the present invention, in relation to which it should also be mentioned that the applicant is not aware of the existence of any other stain-removing machine having technical, structural and configurational features similar to the machine herein proposed.

DESCRIPTION OF THE INVENTION

Thus, the machine proposed by the invention is by itself an obvious novelty within its field of application, since in accordance with its creation a system for the partial cleaning of fabrics is specifically achieved which, assuring an optimal result, limits the washing to the desired area, with the added advantage of not producing creases therein or deteriorations due to friction when the stain is rubbed or brushed, such that, once dried, the action thereon is not noted, avoiding having to wash the garment completely.

Specifically to that end, the machine proposed by the invention is essentially formed by two tubes or containers which are joined and communicated at one of the ends thereof, the area of the fabric to be cleaned being clamped between them, so that a fluid (water, soapy water, gas . . . ) can flow from one to the other, which fluid will clean the fabric upon the passage thereof.

The joining between the tubes or containers can be performed by any closure and adjustment mechanism able to hold up the fabric, preferably quite taut, and prevent the fluid from leaking. The stain would logically be included within the diameter of the tube (completely or partially, depending on the size thereof and the size of the tubes).

Since the fluid flows in one or both directions through the fabric, the stain is dislodged and washed, without deteriorating the fibers due to rubbing and/or brushing.

It should be mentioned that in order for the machine to operate suitably, it may incorporate the appropriate regulating equipment, such as, for example, equipment for regulating the pressure, for replacing or changing the fluid load, whichever is appropriate for each type of operation.

The movement of the liquid inside the tubes is in turn achieved by any propulsion and/or suction mechanism, such as a piston (or propulsion system) moving in both directions, or machines performing pressure propulsion and/or suction of the fluids, being operated by mechanical means, pneumatic means or other automatisms (connecting rod, crank, etc.) or being manually operated, it being possible to have both an open and a closed circuit.

The propulsion system will be placed in one of the tubes or in both, in which case it will have opposite and synchronous movements, whereas in the event that the propulsion is performed only in one of the tubes, the inactive tube could end in an elastic or moving area which shifts to adapt itself and put up resistance to the volume of the displaced fluid, such that once the thrust has ended, the elastic element restores the fluid to the first tube, the repetition of the action with the same fluid load therefore being possible.

Optionally, it is possible for one of the tubes to be filled and discharged directly from the outside or from another container, for example for rinsing.

In the event that only one of the tubes propels the fluid, the latter will be subjected to an adjustable change of pressure, which will aid in the cleaning of the stain.

It should furthermore be mentioned that the machine of the invention can optionally incorporate an air-drying system to perform the fast drying of the fabric once washed, as well as the possibility that the pistons which make the fluid flow rub the fabric, providing a massage thereon collaborating in the cleaning.

Likewise as an alternative option, the invention allows incorporating a preferably elastic permeable bag or basket in the area of adjustment between both tubes, making it possible to introduce the entire garment therein, thus allowing, if desired, washing the entire garment by means of the same system.

It should furthermore be mentioned that the invention contemplates incorporating, on both sides of the cloth with the stain to be cleaned, corresponding perforated membranes or screens, which will serve to secure the fabric, preventing its excessive extension towards both sides of the tubes due to the internal movement of the fluid, which could damage it.

In addition, depending on the type of material that the membranes or screens are made of, since they can be elastic, smooth or not, such membranes or screens are suitable for gently rubbing the fabric with the shifting caused by the pressure or negative pressure of the fluid, increasing the effectiveness of the machine on the stain or stains.

Likewise, plates which can move, for example vibrating by means of applying ultrasounds, can be incorporated.

Meanwhile, by means of the appropriate modifications, the described machine is suitable for being coupled to a professional stain-removing table, of the type previously described in the background section and which is commonly used in dry cleaners and establishments or specialized industries, therefore allowing the use of any type of cleaning product, since its coupling to said table advantageously makes it a closed cleaning system. To that end, one of the tubes or containers of the machine is placed in one part of the table, the guns being coupled to it by means of corresponding leak-tight adapters, and the other tube or container in the opposite part, in which the waste suction device will be coupled, thus preventing the eventual suction of the products used by the operator handling it.

Finally, the described machine is likewise adaptable to a domestic fluid suction source and propulsion source, such as a steam cleaning machine and a vacuum cleaner, with which the direction of the fluid or fluids can be varied, as desired, depending on if they are coupled at one end of the machine or the other, therefore making it a practical, portable and low-cost stain-removing machine for domestic use.

The new stain-removing machine consequently represents an innovative structure with structural and constitutive features unknown up until now for such purpose, which reasons, together with its practical usefulness, give it sufficient basis for obtaining the exclusive privilege that is sought.

BRIEF DESCRIPTION OF THE DRAWINGS

To complement the description being made and for the purpose of aiding to better understand the features of the invention, a set of drawings is attached to the present specification as an integral part thereof, in which the following has been depicted with an illustrative and non-limiting character.

PREFERRED EMBODIMENT OF THE INVENTION

Figure 1:
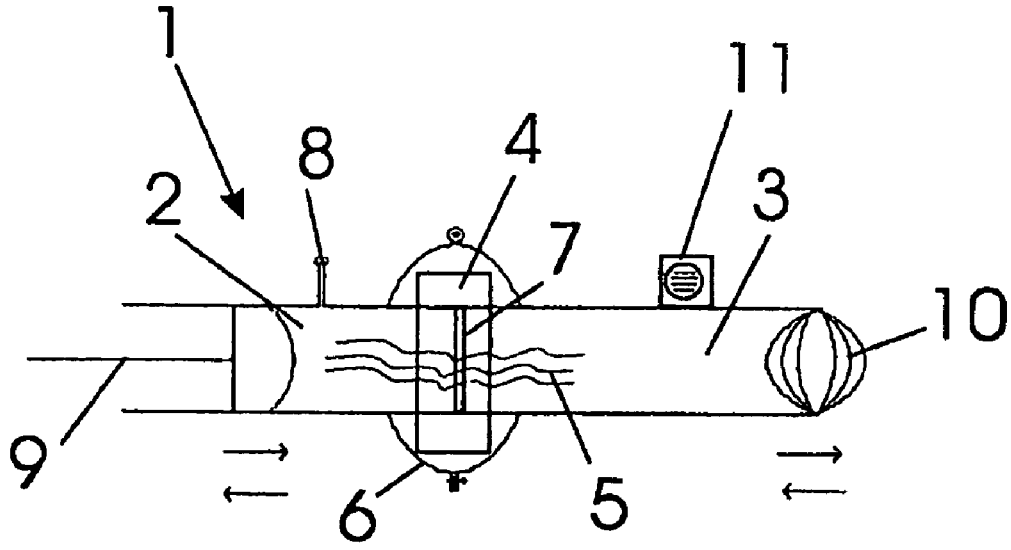
FIG. 1 shows a schematic view of an embodiment of the new machine, showing the main parts and elements comprised therein, as well as their configuration and arrangement, having depicted in this case an example in which the movement of the fluid is performed from only one of the tubes forming the machine.

In view of the mentioned figures, and according to the adopted reference numbers, a preferred embodiment of the new stain-removing machine, comprising the parts and elements indicated and described in detail below, can be observed in such figures.

Thus, as seen in said figures, the machine (1) proposed by the invention is essentially formed by two tubes or containers (2) and (3) which are joined and communicated to one another at one of the ends thereof, the area of the fabric (4) to be cleaned being clamped between them, so that a fluid (5) can flow from one to the other, which fluid will clean the stain or stains that can exist in said area upon the passage thereof through said fabric (4) in both directions by means of dragging particles.

The mentioned joining between the tubes (2) and (3) is performed by means of a conventional closure and adjustment mechanism (6) which can hold up the fabric (4), preferably taut, and prevent the fluid (5) from leaking, so it furthermore has at least one rubber sealing section (7), or one of a similar material, at the end of one of the tubes (2) or (3).

At least one of the mentioned tubes (2), or both (2) and (3), forming the machine (1) has a fill and/or discharge opening or valve (8), for supplying or releasing the fluid (5).

The movement of the fluid (5) inside the machine (1) between the tubes (2) and (3) is in turn achieved by means of a propulsion and/or suction mechanism, such as a piston (9), moving in both directions, operated by mechanic means, pneumatic means (not shown) or other automatisms (connecting rod, crank, etc.) or manually operated, a closed or open circuit being able to be created. The piston can also be substituted with machines or systems performing pressure propulsion and/or suction of the fluids.

Said propulsion system or piston (9), as seen in the schematic depiction of FIG. 1, is placed in one of the tubes (2), there being at the distal end of the other tube (3) an elastic membrane (10), or a moving part, which shifts to adapt itself and put up resistance to the volume of the fluid (5) displaced by the piston (9), such that, once the thrust of the latter has ended, the membrane (10) restores the fluid (5) to the first tube (2), the repetition of the action with the same fluid load (5) therefore being possible.

Figure 2:
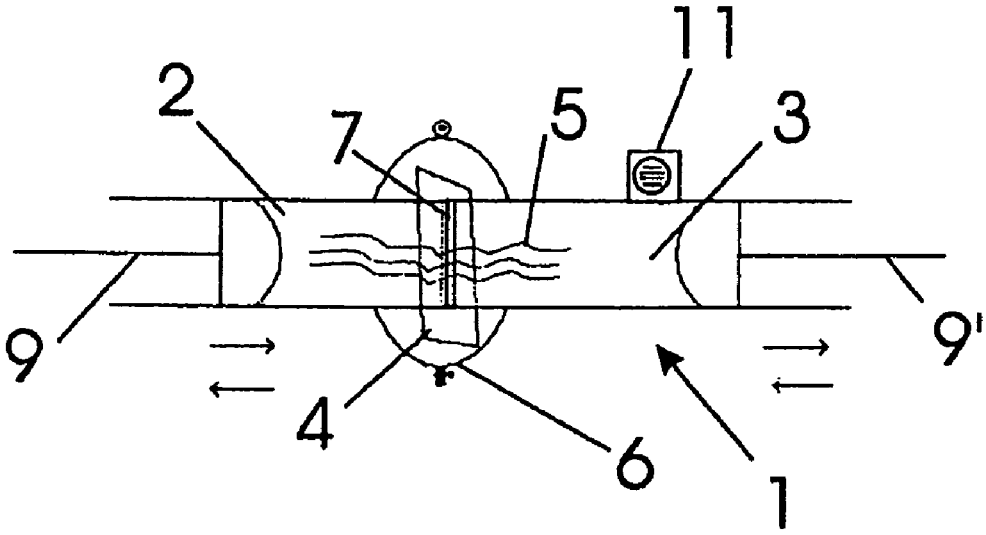
FIG. 2 shows likewise a schematic view of the machine depicted in FIG. 1, incorporating in this case a propulsion system in each of the tubes, such that both operate in opposite and synchronized directions.

Optionally, the stain-removing machine (1) can incorporate a piston or propulsion system (9) and (9') in each tube (2) and (3), as seen in the example depicted in FIG. 2, having, in said case, opposite and synchronous movements which will make the fluid (5) flow from one tube to the other, going through the fabric (4) clamped between them by the closure (6).

It should be mentioned that the described pistons or propulsion systems (9) and (9') making the fluid (5) flow, if desired and by means of the suitable regulation of their shifting inside the respective tubes (2) and (3), can rub the fabric (4), thus providing a massage thereon collaborating in the cleaning.

The machine (1) furthermore, also optionally, incorporates an air-drying system formed by a dryer or suction device (11), suitably connected to the electric system of the machine (1), to perform the fast drying of the fabric (4) once washed.

Figure 3:
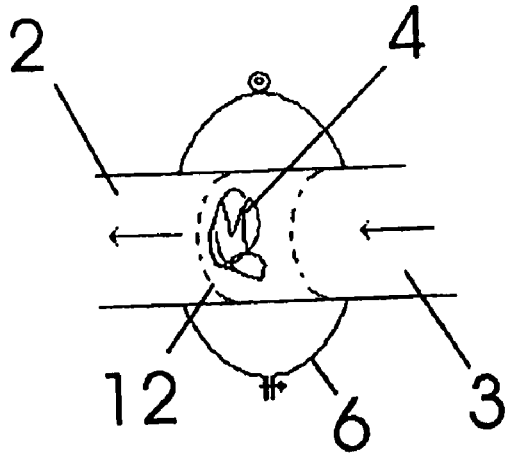
FIG. 3 shows a schematic view of the machine depicted in the previous figures incorporating a basket for the complete introduction of the garment to be washed.

Likewise as an alternative option, the invention incorporates and secures by means of the closure (6) a preferably elastic permeable bag or basket (12) in the area of adjustment between both tubes (2) and (3), which allows introducing the entire garment inside the machine (1) to wash it by means of the described system (FIG. 3).

For its operation, the machine (1) can furthermore have the appropriate regulating equipment, such as, for example, equipment for regulating the pressure, for replacing or changing the fluid load, whichever is appropriate for each type of operation, as well as the appropriate operating system and electrical wiring, where appropriate, for its suitable connection to the network or incorporation of batteries for powering it (not shown).

Figure 4:
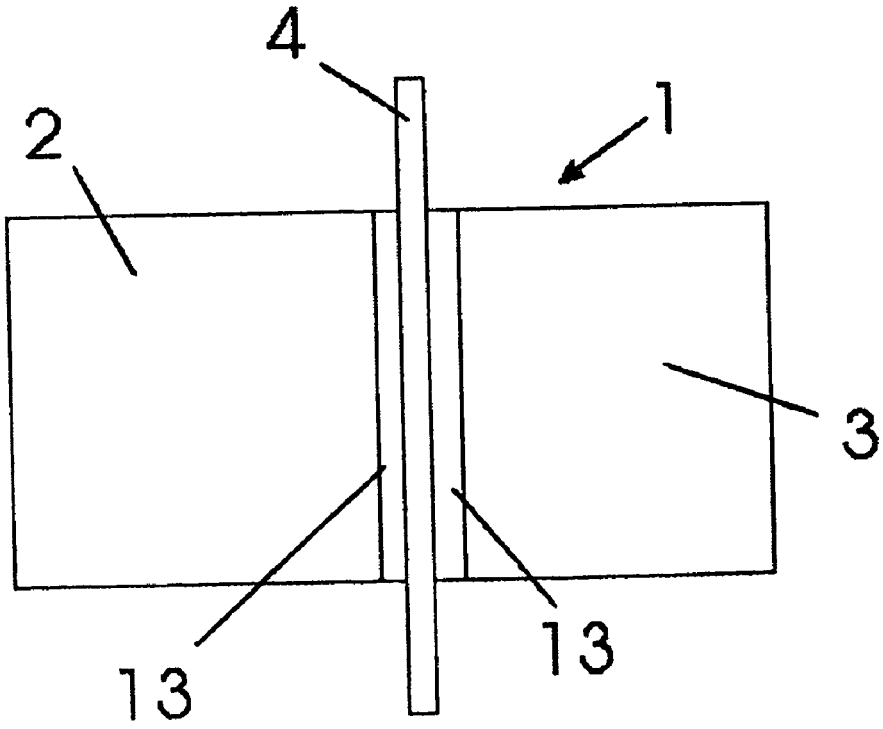
FIG. 4 shows a schematic longitudinal section view of the machine incorporating securing membranes for the fabric.

Regarding FIG. 4, it can be seen how the machine (1) optionally incorporates at the ends of each tube (2) and (3), such that they are on both sides of the cloth (4), corresponding perforated membranes, or screens (13), securing said fabric (4), preventing its excessive extension towards both sides of the tubes due to the internal movement of the fluid (5) during the operation of the machine, which could damage it.

Said membranes or screens (13) can be elastic, smooth or not, in which case they are suitable for gently rubbing the fabric (4) due to the shifting caused by the pressure or negative pressure of the fluid (5), increasing the effectiveness of the machine on the stain or stains.

Figure 5:
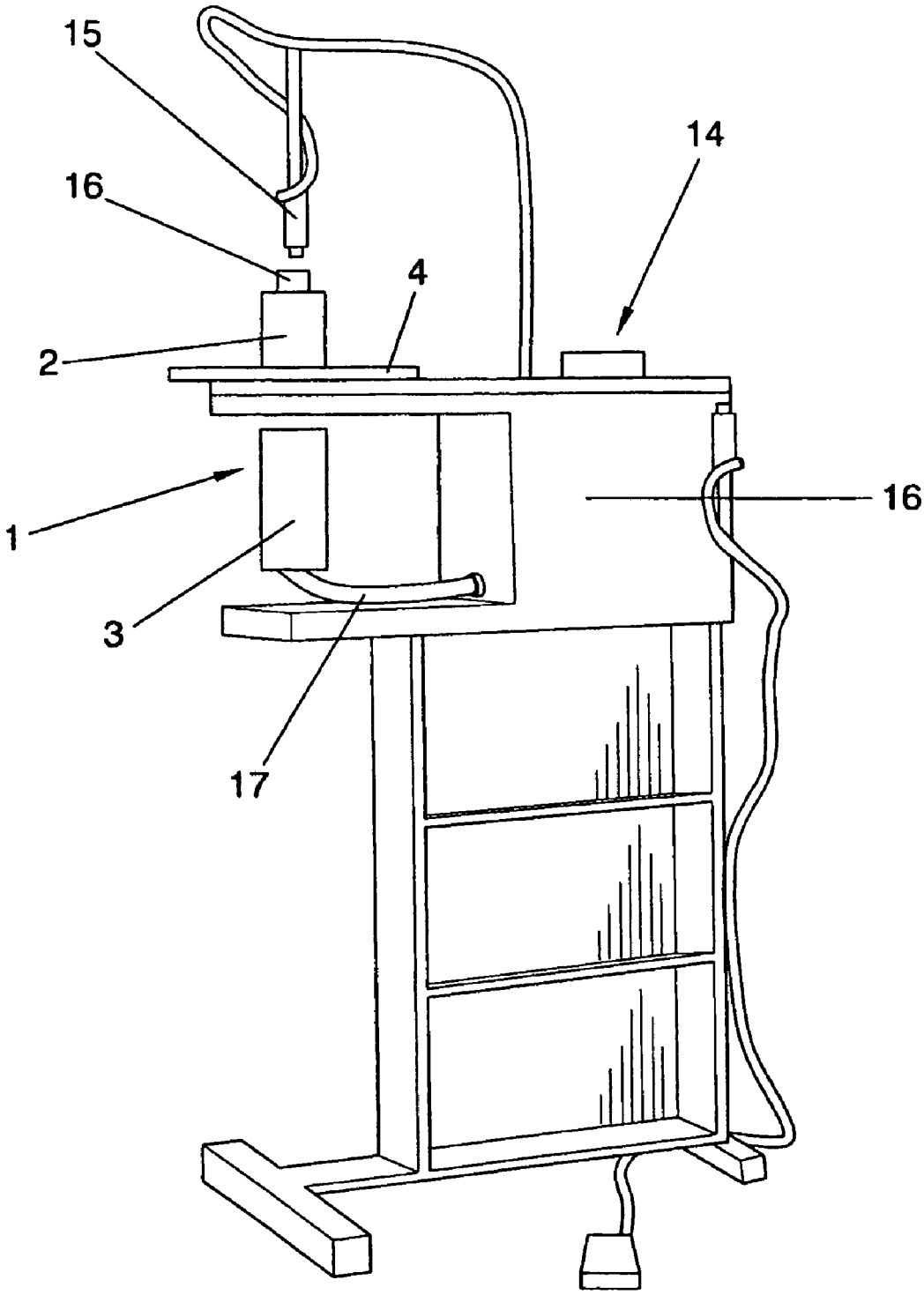
FIGS. 5 and 6 respectively show corresponding examples for coupling the machine object of the invention to a professional stain-removing table and to a domestic suction source and propulsion source.

FIG. 5 shows an embodiment of the machine (1) coupled to a professional stain-removing table (14), one of the tubes (2) of the machine having been incorporated in one of the parts of the table (14) (the upper part in the example, but could be in another part) on a screen provided therein, the guns (15) which spray the cleaning products being coupled to it by means of corresponding leak-tight adapters (16), and the other tube (3) in the opposite part, in which a waste suction device (17) will be coupled, making the table a closed cleaning system suitable for applying any type of product, even chlorinated products.

Figure 6:
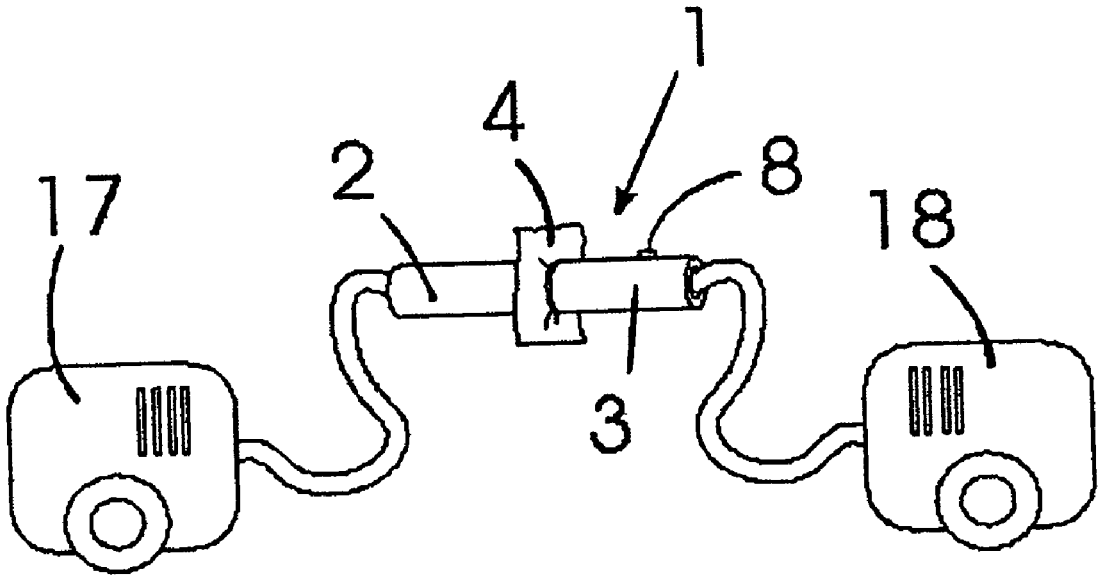

Finally, FIG. 6 shows the machine (1) in another embodiment, in this case coupled at the distal end of one of the tubes (2) to a domestic vacuum cleaner (18) and at the distal end of the other tube (3) to a steam cleaning machine (19), which provide the necessary propulsion to the fluid (5) for the operation of the machine, the direction thereof being able to be varied, as desired, depending on if the vacuum cleaner (18) and the steam cleaning machine (19) are coupled at one end of the stain-removing machine (1) or the other end.

Additionally, plates (not shown) which can move, for example vibrating by means of applying ultrasounds thereon, aiding in the removal and cleaning of the stain, can be incorporated in the area of adjustment between the tubes or containers (2) and (3).

Having sufficiently described the nature of the present invention as well as how to put it into practice, it is not considered necessary to further the explanation thereof so that a person skilled in the art has sufficient information to understand its scope and the advantages derived therefrom, as well as to be able to carry out the reproduction thereof, hereby stating that, within its essential nature, it could be put into practice in other embodiments differing in detail from the one indicated by way of example, and which will likewise be subject to the protection sought provided that its fundamental principle is not altered, changed or modified.

The invention claimed is:

1. A stain-removing machine, comprising:

two tubes which are joined and communicated to one another at one of the ends thereof, an area of fabric to be cleaned being clamped between them, so that a fluid can flow from one to the other; wherein the joining between the tubes comprises a closure and adjustment mechanism, which can hold up the fabric; wherein at least one of said tubes has a fill and/or discharge opening or valve for supplying or releasing the fluid directly from the outside or from another container; and perforated elastic membranes or screens securing said fabric, at the ends of each tube, such that they are on both sides of the fabric, said membranes or screens being arranged for gently rubbing the fabric due to shifting caused by pressure or negative pressure of the fluid, wherein the stain-removing machine comprises at least one of the features of:

(i) one of the tubes of the machine being incorporated in one part of a stain-removing table on a screen therein, to which spray guns for spraying cleaning products are coupled by leak-tight adaptors, and the other tube being incorporated in an opposite part of the table and arranged for coupling to a waste suction device, and (ii) comprising a suction source coupled at the distal end of one of the tubes to provide propulsion to the fluid in operation of the machine, and a propulsion source coupled to the distal end of the other tube to provide propulsion to the fluid in operation of the machine, the direction thereof being able to be varied, as desired, depending on if the suction source and the propulsion source are coupled at one end of the stain-removing machine or the other end of the stain-removing machine.

2. The stain-removing machine according to claim 1, comprising a mechanism, machine or system for the pressure propulsion and/or suction of fluids, to effect movement of the fluid between the tubes, and operable by mechanical means, pneumatic means or other automatisms or manually operable, to form a closed or open circuit.

3. The stain-removing machine according to claim 2, wherein a propulsion system or piston is disposed in one of the tubes, and wherein an elastic membrane or a moving part is disposed at the distal end of the other tube, and shifts to adapt itself and exert resistance to a volume of the fluid displaced by the propulsion system or piston.

4. The stain-removing machine according to claim 2, comprising a piston or propulsion system in each tube having opposite and synchronous movements in relation to one another.

5. The stain-removing machine according to claim 1, comprising pistons in each of said tubes, wherein the pistons are arranged to rub the fabric, providing a massaging action thereon assisting cleaning of the fabric, and wherein the pistons are arranged for regulation of their shifting inside the respective tubes.

6. The stain-removing machine according to claim 1, comprising an air-drying system to perform fast drying of the fabric once it has been washed.

7. The stain-removing machine according to claim 6, wherein said air-drying system comprises a dryer or suction device connected to an electric system of the machine.

8. The stain-removing machine according to claim 1, comprising a closure including a permeable bag or basket in an area of adjustment between both tubes, allowing an entire garment to be fully washed in the machine.

9. The stain-removing machine according to claim 8, wherein said permeable bag is elastic.

10. The stain-removing machine according to claim 1, wherein one of the tubes of the machine is incorporated in one part of the table on a screen therein, to which spray guns for spraying cleaning products are coupled by leak-tight adapters, and wherein the other tube is incorporated in an opposite part of the table and arranged for coupling to a waste suction device.

11. The stain-removing machine according to claim 1, comprising a suction source coupled at the distal end of one of the tubes to provide propulsion to the fluid in operation of the machine, and a propulsion source coupled to the distal end of the other tube to provide propulsion to the fluid in operation of the machine, the direction thereof being able to be varied, as desired, depending on if the suction source and the propulsion source are coupled at one end of the stain-removing machine or the other end of the stain-removing machine.

12. The stain-removing machine according to claim 11, wherein the suction source comprises a vacuum cleaner.

13. The stain-removing machine according to claim 11, wherein the propulsion source comprises a steam cleaning machine.

14. The stain-removing machine according to claim 1, comprising vibratory plates in an area of adjustment between the tubes or containers to assist in the removal and cleaning of stains.

15. The stain-removing machine according to claim 14, wherein said vibratory plates comprise ultrasonic vibratory plates.

16. The stain-removing machine according to claim 1, wherein said mechanism, machine or system comprises a bidirectionally moveable piston.

17. A stain-removing machine, comprising:

two containers which are joined and communicated to one another at one of the ends thereof, an area of fabric to be cleaned being clamped between them, so that a fluid can flow from one to the other; wherein the joining between the containers comprises a closure and adjustment mechanism, which can hold up the fabric; wherein at least one of said containers has a fill and/or discharge opening or valve for supplying or releasing the fluid directly from the outside or from another container; and perforated elastic membranes or screens securing said fabric, at the ends of each container, such that they are on both sides of the fabric, said membranes or screens being arranged for gently rubbing the fabric due to shifting caused by the pressure or negative pressure of the fluid, wherein the stain-removing machine comprises at least one of the features of:

(i) one of the tubes of the machine being incorporated in one part of a stain-removing table on a screen therein, to which spray guns for spraying cleaning products are coupled by leak-tight adaptors, and the other tube being incorporated in an opposite part of the table and arranged for coupling to a waste suction device, and (ii) comprising a suction source coupled at the distal end of one of the tubes to provide propulsion to the fluid in operation of the machine, and a propulsion source coupled to the distal end of the other tube to provide propulsion to the fluid in operation of the machine, the direction thereof being able to be varied, as desired, depending on if the suction source and the propulsion source are coupled at one end of the stain-removing machine or the other end of the stain-removing machine.

* * * * *